US005084695A

United States Patent [19]

Freeman

[11] Patent Number: 5,084,695

[45] Date of Patent: Jan. 28, 1992

[54] UMPIRE'S COUNTER

[76] Inventor: Jeffrey S. Freeman, 136 James Ave., Waynesboro, Va. 22980

[21] Appl. No.: 548,370

[22] Filed: Jul. 5, 1990

[51] Int. Cl.[5] ..... G08B 23/00; G06F 15/28

[52] U.S. Cl. ..... 340/323 R; 340/384 R; 340/384 E; 364/410; 364/411; 116/222; 273/25; 273/88; 235/1 B; 377/5

[58] Field of Search ..... 340/323 R, 384 ER; 273/25, 88, 150; 235/1 B, 123, 145 R; 377/5, 107; 116/222, 223; 364/410, 411

[56] References Cited

U.S. PATENT DOCUMENTS

| | | | |
|---|---|---|---|
| 2,993,288 | 7/1961 | Rothman . | |
| 3,455,273 | 7/1969 | Willingham, Jr. . | |
| 3,554,159 | 1/1971 | Klupt . | |
| 3,755,939 | 9/1973 | Denega et al. . | |
| 4,072,125 | 2/1978 | Spalla . | |
| 4,108,036 | 8/1978 | Slaymaker | 364/410 |
| 4,266,214 | 5/1981 | Peters, Jr. | 340/323 R |
| 4,968,030 | 11/1990 | Frymire | 364/411 |

*Primary Examiner*—Donnie L. Crosland

*Attorney, Agent, or Firm*—Joe M. Muncy

[57] ABSTRACT

An umpire's counter is provided with a housing having a top face and a bottom face. On the side of the housing between the faces, inputs for advancing a balls display, a strikes display, an outs display and an inning display are provided. A separate button is provided for clearing at least the strikes and balls display. A strap can be provided on the back of the umpire's counter which encircles the umpire's hand of encircles two of the umpire's fingers. The strap enables the umpire to make a "safe call" without dropping the counter. An audible output is provided for indicating when at least the balls or strikes displays have been advanced. Each of the inputs are provided in recesses with covers to prevent inadvertent actuation of the displays. A time, score or alarm set display is provided and buttons are provided for advancing the home and visitors score or advancing the hours and minutes during alarm setting. The counter readily fits in an umpire's hand and provides selectively illuminatable displays which are easy to see even when the game is played under lights.

22 Claims, 3 Drawing Sheets

UMPIRE'S COUNTER

BACKGROUND OF THE INVENTION

1. Field of the Invention

The present invention relates to a hand-held umpire's counter with a sound generator for emitting sounds of different tonal quality to confirm actuation of a particular button.

2. Description of the Background Art

Conventional umpire's counters are known, but these counters fail to have audible differentiation means when the various displays are incremented. Thus, an umpire may inadvertently increment one of the displays. Also, the umpire must look at the counter when incrementing the displays in order to be certain as to which display is incremented.

SUMMARY OF THE INVENTION

Accordingly, it is a primary object of the present invention to provide an umpire's counter which has an audible means to confirm incrementing of at least the balls display and the strikes display. Therefore, the umpire does not need to look at the counter upon each incrementing of these displays.

It is another object of the present invention to provide an umpire's counter which avoids inadvertent actuation of the displays.

It is a further object of the present invention to provide an umpire's counter which incorporates LED or LCD displays for ease in viewing.

It is still a further object of the present invention to provide an umpire's counter with a clock incorporated therein. Therefore, games can be played on a timely basis, if required, and an umpire need not wear jewelry such as a watch.

It is yet another object of the present invention to provide an umpire's counter which will aid an umpire in keeping score of the game.

Still yet another object of the present invention is to provide an umpire's counter which will facilitate an umpire's decision to apply the "slaughter rule".

A further object of the present invention is to provide an umpire's counter which will have a strap enabling the operator to more freely make calls without fear of dropping the indicator.

Yet another object of the present invention is to provide an umpire's counter which is easy to carry and operate.

Another object of the present invention is to provide an umpire's counter which is inexpensive to manufacture and easy to maintain.

These and other objects of the present invention are fulfilled by providing an umpire's counter with a housing having at least a balls display, a strikes display, an outs display and an inning display. Separate buttons or inputs are provided for advancing each of the displays. A control means is responsive to incrementing of each of the displays and an audible means is provided for emitting at least a first tone upon incrementing of the balls display and a second tone upon incrementing of the strikes display. The first and second tones are different from one another such that the umpire can audibly differentiate between incrementing of the balls and strikes display.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
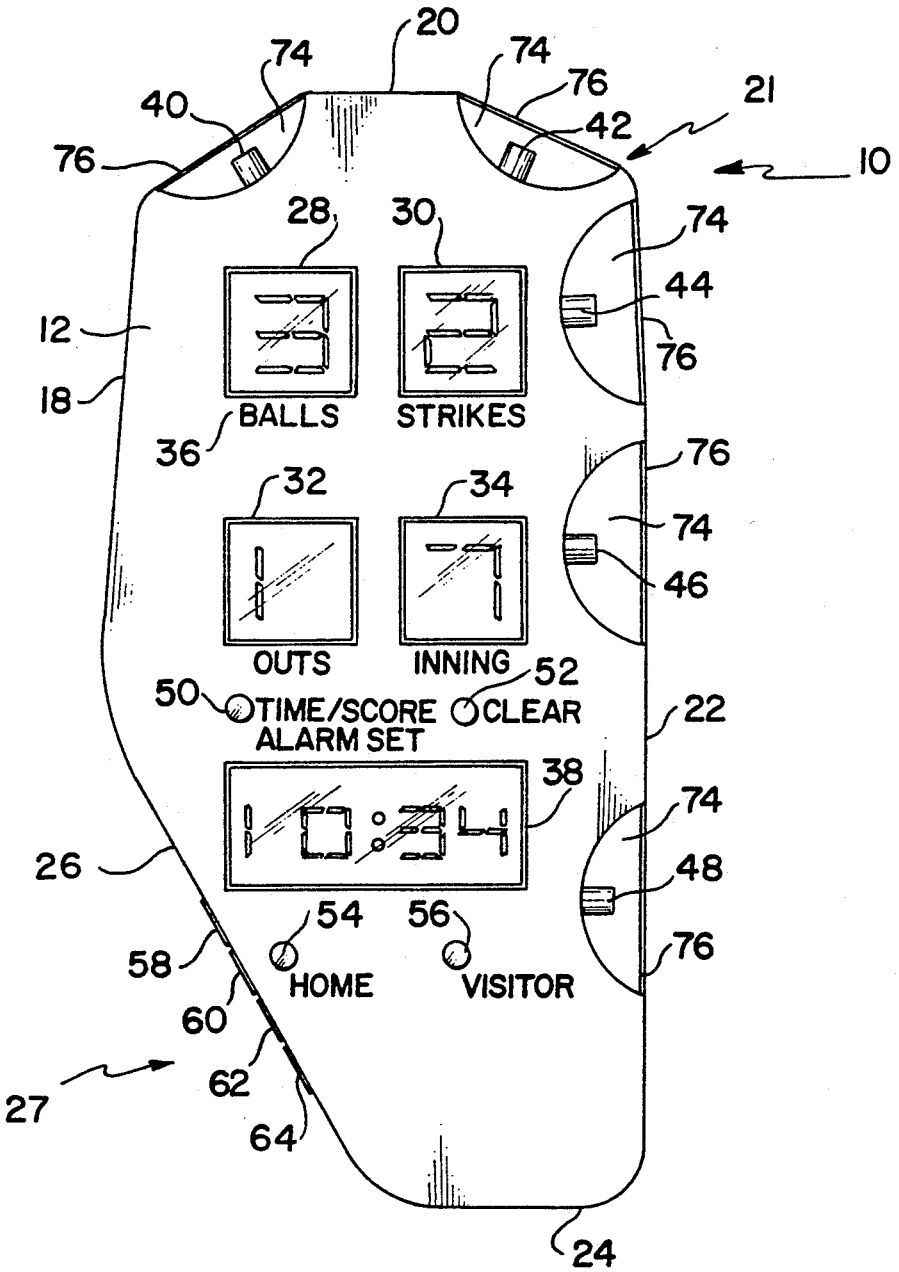
FIG. 1 is a top plan view of the umpire's counter of the present invention.
Figure 2:
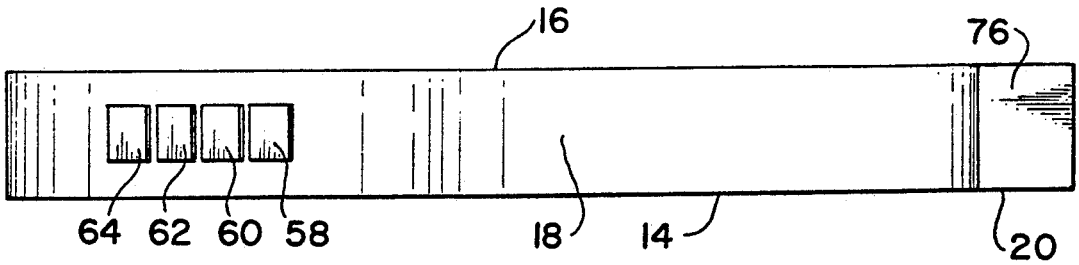
FIG. 2 is a side view of the umpire's counter of the present invention.

Referring in detail to the drawings and with particular reference to FIG. 1, an umpire's counter 10 is shown. This counter includes a housing 12 having a top face 14 and bottom face 16 as indicated in FIG. 2. As further shown in FIG. 1, the housing includes a first side 18, a second side 20, a third side 22, a fourth side 24 and a fifth side 26. While five sides are indicated, it should be understood that any configuration could be used for the umpire's counter. This counter is generally designed to be easily carried by an umpire. The second side 20 and third side 22 can be grouped together as a first side portion while the fifth side 26 can be considered a second side portion 27.

The first side portion 21 contains various means for incrementing the displays as will be discussed below. These displays include a balls display 28, a strikes display 30, an outs display 32 and an inning display 34. Below each display is an indicia 36 for indicating what is shown in the display. Any of the shown indicia 36 can be omitted when the counter is manufactured.

Also provided on the top face 14 of the housing 12 is a time/score/alarm display 38. As seen in FIG. 1, a time can be shown in this display 38. However, this display can also show an alarm set time or team scores as will be discussed below.

Provided on the first side portion 21 is a balls input 40, a strikes input 42, an outs input 44 and an innings input 46. Each of these inputs comprises a button located in a recess 74. Provided over the recess 74 is a cover 76. While FIG. 1 shows the recesses as being opened on the side, these recesses could be enclosed by the cover 76. Also, one single member 76 can cover each of the recesses 74 or separate covers can be provided for each of the recesses. By recessing the various inputs 40, 42, 44 and 46, inadvertent actuation of the balls display 28, strikes display 30, outs display 32 and inning display 34 can be avoided.

The balls input 40 is positioned such that it can be operated by the umpire's thumb when the umpire's counter 10 is held in the umpire's hand. The umpire's forefinger can advance the strikes display 30 by pushing input 42. The forefinger or middle finger of the umpire can be used for advancing the outs display 32 by pressing the outs input 44. The umpire's middle finger can be used to press the innings input 46 to advance the innings. The balls display 28 will advance from 0 to 1 to 2 to 3 to 4 and then return to 0. The strikes display 30 will advance from 0 to 1 to 2 to 3 and then back to 0. The outs display will advance from 0 to 1 to 2 to 3 and then back to 0 while the innings display will advance from 1 through 9.

Figure 5:
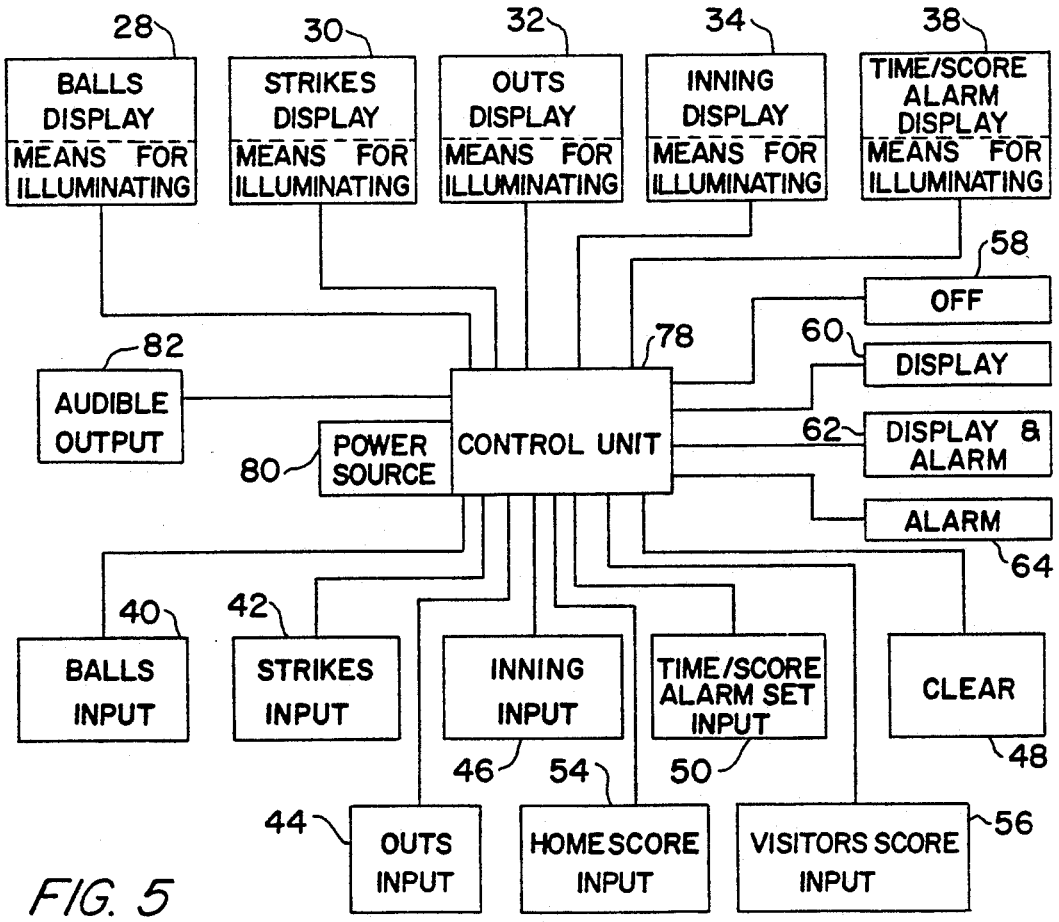
FIG. 5 is a schematic diagram indicating the control arrangement of the umpire's counter of the present invention.

The various displays 28, 30, 32 and 34 as well as the time/score/alarm display 38 can be an LED or LCD. As indicated in FIG. 5, lighting can be provided for each of the displays. For example, a means for illuminating 28*a* may be provided for the balls display 28. Similar means for illuminating 30*a*, 32*a*, 34*a* and 38*a* can be provided for the strikes display 30, the outs display 32, the inning display 34 and the time/score/alarm display 38, respectively. Such means for illumination can include backlighting or other suitable means. Provision of these means for illumination will make it easier for the umpire to see the various displays at a glance. This feature is especially helpful when games are played at night under lights. The umpire's counter can be designed to selectively turn these means for illumination on or off.

As further seen in FIG. 1, a clear button 48 is provided on the first side portion 21. This clear button 48 is also located in a recess 74 with a cover 76 thereover. This clear button 48 can be actuated by the ring finger of the umpire when the umpire's counter 10 is held in the umpire's hand. Upon actuation of clear button 48, the balls display 28 and strikes display 30 will show numeral "0". Therefore, if the balls display 28 and/or strikes display 30 had been incremented, they can be cleared upon actuation of clear button 48.

On the top face 14 of housing 12 is a time/score/alarm set button 50. This button 50 is almost flush with the top face 14 of the housing 12 whereby inadvertent actuation of this button can be avoided. This button 50 may also be recessed slightly below the top face 14. Next to button 50 is a clearing button 52 while a home score input button 54 and visitor's score input button 56 are provided below the time/score/alarm display 38. This particular configuration for buttons 50, 52, 54 and 56 can be varied. For instance, these buttons can be located on any side of the housing, above the display, at either side of the display or below the display.

Also, while buttons are used, it is contemplated that recessed actuation means can be used. Such recessed actuation means can be actuated by an umpire's fingernail or by a pin or the like which is pressed into the recess. Likewise, it should be noted that the time/score/alarm display 38 could be located above, below, between or to the sides of any of the displays 28, 30, 32 and 34. Various configurations for all of the displays are contemplated.

The time/score/alarm button 50 can be pressed once to change display 38 from a time display (as shown in FIG. 1) to a score display. Further actuation of this button 50 will cause display 38 to change from a score display to an alarm set mode. In the alarm set mode, actuation of button 54 will advance the hours while actuation of the visitor's button 56 will advance the minutes. An alarm symbol (such as a bell) can further be shown on display 38 to indicate when an alarm has been set. After the proper time has been selected for the alarm, button 50 can then be pressed to return display 38 to time. In this manner, an alarm can be set on the umpire's counter 10. This alarm is helpful in large cites or tournaments which have many teams and games to be played. In such instances, a time limit per game is used to assure that all games can be played on a timely basis. Moreover, umpires as a rule should not wear jewelry while working. This time feature eliminates the need to carry a watch in the umpire's pocket.

Upon actuation of button 50 to cause display 38 to show a score, the umpire can use the counter 10 to keep score of the two teams. Actuation of button 54 will advance the home team score while actuation of button 56 will advance the visitor's score. Both the home and visitor's score can simultaneously be shown on display 38. By keeping track of team scores, the umpire can make a decision if there is any scoring discrepancies between the teams involved. Upon actuation of button 52, the team scores can be cleared.

Figure 3:
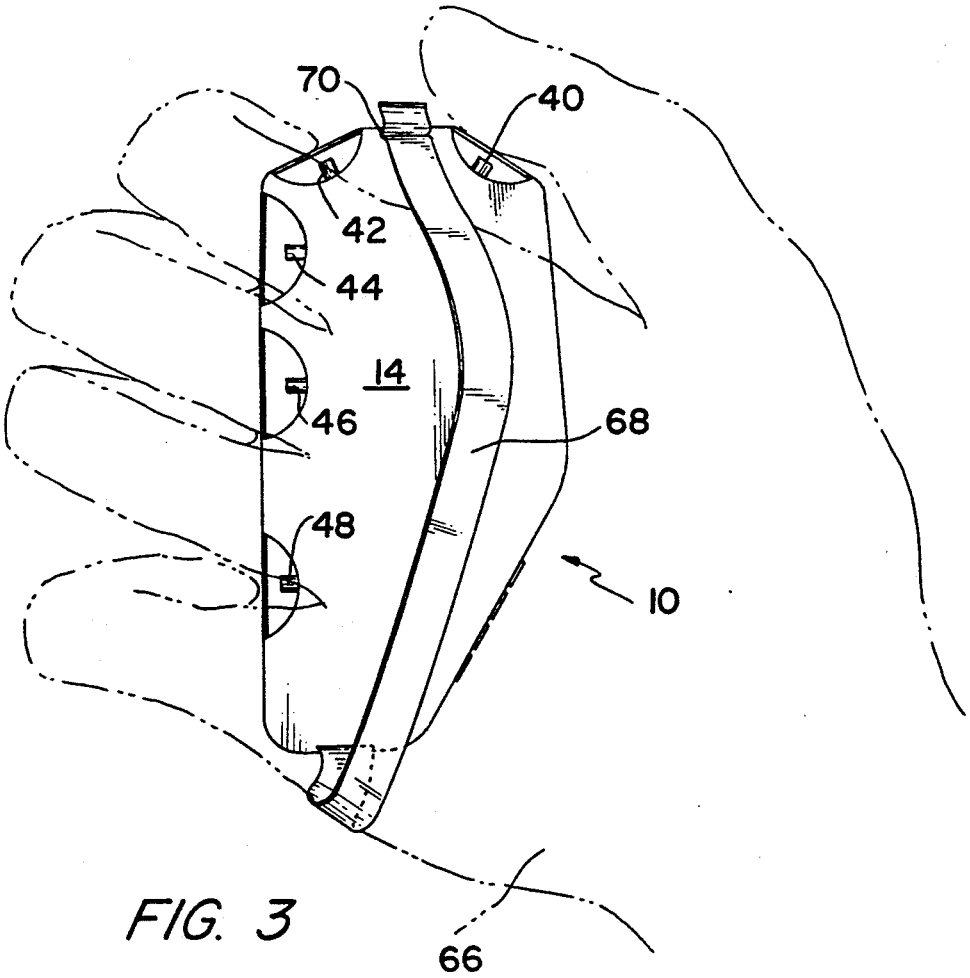
FIG. 3 is a back view showing the umpire's counter of the present invention held in an operator's hand.

On the fifth side 28 of the second side portion 27 of the housing are various switches 58, 60, 62 and 64. As shown in FIG. 3, these switches are located at a side of the housing away from the fingers of the umpire. Therefore, it is unlikely that they will be inadvertently actuated when the umpire is using the counter. While the term "switches" has been used, it is contemplated that sliding switches, switches which are pressed or any other suitable means can be used.

The first switch 58 is an on-off switch for the umpire's counter. The second switch 60 is a switch for actuating the displays 28, 30, 32, 34 and 38. Actuation of switch 60 will override the audible means 82 such that the umpire's counter only changes the respective display upon actuation of the balls input 40 and strikes input 42. A third switch 62 is provided for actuating the displays 28, 30, 32, 34 and 38 as well as the audible means 82. Finally, a fourth switch 64 is provided for turning the alarm on and off. While these switches 58, 60, 62 and 64 are shown as being located on the fifth side 26, these switches can be located on any portion of the umpire's counter. Moreover, these switches can be recessed below the surface of the umpire's counter if so desired.

In FIG. 3, the back of the umpire's counter 10 is shown. This figure indicates how the counter can be held in an umpire's hand 66 and how the various inputs 40, 42, 44, 46 and 48 can be actuated by the umpire. As further indicated in this FIG. 3, a strap 68 can be provided. This strap can encircle the hand of the operator. A means 70 is provided for adjusting the size of the strap to accommodate different sized hands. It is noted that this strap 68 and means for adjusting 70 can be omitted, if so desired, as shown in FIG. 2.

Figure 4:
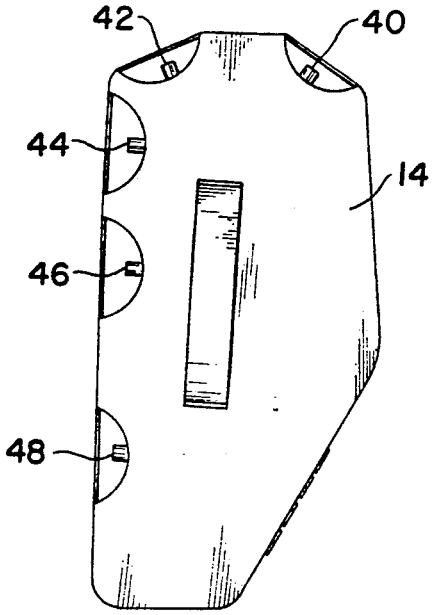
FIG. 4 is a back view of the umpire's counter of the present invention showing a second embodiment of a holding strap.

As further shown in FIG. 4, a second type of strap 72 is used. This strap will slip over one or two of the umpire's fingers. An adjustment means (not shown) can also be used with this strap 72. By providing either strap 68 or 72, the umpire's counter 10 can be easily carried by the umpire. Additionally, when certain calls are made, such as a "safe call", the umpire can be assured that he or she will not drop the counter.

As further seen in FIG. 5, a control unit 78 is provided. This control unit 78 can be an IC chip or other microprocessing means. Operatively connected to the control unit 78 is a power source 80. This power source 80 can be a battery or the like which can be inserted within the umpire's counter 10. While an opening is not shown in the umpire's counter for insertion of the battery, such an opening can be provided. Alternatively, the top face 14 or bottom face 16 can be separated from the housing 12 in order to insert or remove a battery or the like.

Each of the displays 28, 30, 32, 34 and 38 are connected to the control unit 78. Also connected to this control unit 78 are the inputs 40, 42, 44, 46 and 48. The time/score/alarm set input 50, the home score input 54 and the visitor score input 56 are also connected to the control unit 78. While FIG. 5 indicates inputs 54 and 56 as being a home score and visitor score input, it should be recognized that the hour advance and minute advance are also carried out by these inputs 54 and 56, respectively. Additionally, the on switch 58, display switch 60, display and alarm switch 62 and alarm switch 64 are all connected to the control unit 78. Each of the displays 28, 30, 32, 34 and 38 have a means for illuminating 28*a*, 38, 32*a*, 34 and 38*a*, respectively. While separate means for illuminating are indicated, it should be understood that a single illumination means can be used if so desired.

An audible output 82 is also connected to the control unit 78. This audible output can emit a different tone upon actuation of at least the balls input 40 and strikes input 42. Therefore, an umpire can be certain of which of these displays have been incremented. This feature is especially helpful in cold weather when an umpire wants to keep his or her hands in their pockets. An umpire is therefore not required to look at the counter upon each increment of the balls and strikes display. The tone for the strikes and balls incrementing will be different such that it will be clear which display has been changed.

Further, the audible means 82 can provide distinctive tones for incrementing each of the displays 28, 30, 32 and 34. In this way, the umpire will hear if a particular display has been inputted. He or she will then be able to confirm which display has been incremented or whether a display has inadvertently been incremented. For instance, if one of the inputs 40, 42, 44, 46 were somehow inadvertently hit, a tone would be emitted. The umpire would then immediately be alerted as to which display had been incremented and could take corrective action. The clear button 48 can also have a distinctive tone associated therewith.

The control unit 78 can also keep track of the innings and runs. If after five innings a team is ahead by ten or more runs, then the control unit 78 can cause the audible means 82 to actuate a particular alarm. Alternatively, the display 38 can be actuated to indicate that one team has won the game. In this manner, the umpire's counter 10 can automatically indicate when a particular team has won if a slaughter rule is being used. However, if this rule is not being used, the umpire can simply press the clear button 52, for example, in order to continue play of the game.

The umpire's counter 10 of the present invention is easy to operate and to manufacture. Little maintenance is required with this device and it has few moving parts which are subject to wear. The device is readily portable and can easily fit in the umpire's hand or pocket. By using this device, the umpire may keep his or her hands in their pockets during cold weather. Provision of LED or LCD displays helps the umpire see game information at a glance. Moreover, the LED or LCD readout is easy to see when games are played under lights. This umpire's counter can automatically indicate when the slaughter rule applies and avoids the need for an umpire to carry a watch in his or her pocket. Timed play is facilitated with the instant umpire's counter and the umpire can easily keep score of the game thereby avoiding disputes between the teams. Provision of either type of carrying strap makes the umpire's counter easy to carry and enables the umpire to freely use his or her hands in making calls.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An umpire's counter comprising:

a housing having at least a balls display, a strikes display, an outs display and an inning display;

means operatively connected to said housing for selectively incrementing each of said displays;

control means responsive to the means for incrementing for changing one of the displays upon actuation of said means for incrementing; and audible means operatively connected to said control means for emitting at least a first tone when said balls display is incremented and a second tone when said strikes display is incremented, said first and second tones being different from one another whereby an operator can audibly differentiate whether the balls display or strikes display have been incremented.

2. The umpire's counter as recited in claim 1, further comprising:

a time/score display in said housing for sequentially displaying at least time and score; and means for switching said time/score display between display of time and display of team scores.

3. The umpire's counter as recited in claim 1, wherein said means for incrementing comprises:

a first input for incrementing the balls display;

a second input for incrementing the strikes display;

a third input for incrementing the outs display; and a fourth input for incrementing the inning display;

said first, second, third and fourth inputs being located on at least one side of the housing.

4. The umpire's counter as recited in claim 3, wherein each of the first, second, third and fourth inputs are buttons located in separate recesses formed on the at least one side of the housing at a first portion thereof, the first portion of the side being engageable by the fingers of an operator's hand when the counter is being held in the hand and said umpire's counter further comprising cover means which cooperate with the recesses for aiding in prevention of inadvertent actuation of each of the inputs.

5. The umpire's counter as recited in claim 4, further comprising a clear button located in a separate recess in the at least one side of the housing, said clear button clearing at least the balls and strikes display upon actuation thereof and said cover means also cooperating with the recess for the clear button to aid in prevention of inadvertent actuation of the clear button.

6. The umpire's counter as recited in claim 5, wherein the audible means emits a clearing tone upon actuation of the clear button, said clearing tone being different from said first and second tones.

7. The umpire's counter as recited in claim 4, further comprising:

a time/score display in said housing for sequentially displaying at least time and score; and means for switching said time/score display between display of time and display of team scores.

8. The umpire's counter as recited in claim 7, further comprising means for clearing the display of team scores, said housing having a top face and a bottom face and said means for clearing being located on said top face of the housing.

9. The umpire's counter as recited in claim 1, wherein the housing has a top face and a bottom face and at least one side therebetween and said umpire's counter further comprises:

a first switch on the at least one side of the housing for turning the counter on and off;

a second switch for actuating the displays and for overriding the audible means on the at least one side of the housing; and a third switch for actuating the displays and the audible means on the at least one side of the housing.

10. The umpire's counter as recited in claim 9, wherein the at least one side of the housing comprises a first portion engageable by the fingers of an operator's hand and a second portion generally being nonengageable by the fingers of the operator's hand when the counter is being held in the hand, the first portion of the side having the means for incrementing and the second portion of the side having the first switch, the second switch and the third switch.

11. The umpire's counter as recited in claim 10, further comprising:

a time/score display in said housing for sequentially displaying one of time, score and alarm set;

means located on the top face of the housing for switching said time/score display between display of time and display of team scores and for setting an alarm to indicate a desired time; and a third switch located on the second portion of the side for turning the alarm on and off.

12. The umpire's counter as recited in claim 1, wherein said housing has a top face and a bottom face, said counter further comprising means on the bottom face of the housing for holding the counter in a hand of an operator.

13. The umpire's counter as recited in claim 12, wherein said means for holding comprises a strap which encircles the hand of the operator and an adjustment means for adjusting the size of the strap to the operator's hand size.

14. The umpire's counter as recited in claim 12, wherein said means for holding comprises a strap which encircles two of the fingers of the hand of the operator.

15. The umpire's counter as recited in claim 1, further comprising means for illuminating said balls display, said strikes display, said outs display and said innings display, said means for illuminating being operatively connected to said control means.

16. The umpire's counter as recited in claim 1, wherein the balls display, the strikes display, the outs display and the inning display are one of an LED and LCD.

17. The umpire's counter as recited in claim 1, wherein the housing is sized to be held in an operator's hand and generally has five sides, the means for incrementing comprises four buttons located on two of the sides of the housing, the button for incrementing the balls display being positioned for operation by the thumb of the user, the button for incrementing the strikes display being positioned for operation by the forefinger of the operator, the button for incrementing the outs display being positioned for operation by one of the forefinger and middle finger of the operator, and the button for incrementing the inning display being positioned for operation by the middle finger of the operator when the umpire's counter is held in the operator's hand.

18. The umpire's counter as recited in claim 1, further comprising a clear button located on one of the two sides of the housing, said clear button clearing at least the balls and strikes display upon actuation thereof and said clear button being positioned for operation by the ring finger of the operator.

19. The umpire's counter as recited in claim 1, wherein the audible means emits a third tone when said outs display is incremented and a fourth tone when said inning display is incremented, each of said first, second, third and fourth tones being different from one another.

20. The umpire's counter as recited in claim 1, wherein the control means further determines if a predetermined number of innings has been played and whether one team is ahead by a predetermined score and thereafter provides an indication to the operator.

21. The umpire's counter as recited in claim 1, further comprising at least a time display in the housing.

22. The umpire's counter as recited in claim 21, wherein the time display further sequentially displays team scores and alarm set upon actuation of a means for switching the time display, said umpire's counter thereby having a time function, a score function and an alarm function.

* * * * *